United States Patent [19]

Hanson

[11] 4,017,130

[45] Apr. 12, 1977

[54] DISPLAY CASE

[75] Inventor: Jerry D. Hanson, Spring Lake, Mich.

[73] Assignee: Structural Concepts Corporation, Spring Lake, Mich.

[22] Filed: Nov. 6, 1975

[21] Appl. No.: 629,292

[52] U.S. Cl. ..... 312/128; 211/119; 312/223; 312/126

[51] Int. Cl.[2] ..... A47F 3/06

[58] Field of Search ..... 312/114, 126, 128, 223; 211/119, 153, 181, 90

[56] References Cited

UNITED STATES PATENTS

| | | | |
|---|---|---|---|
| 2,125,523 | 8/1938 | Smith | 312/114 |
| 2,827,555 | 3/1958 | Wooley | 211/90 X |
| 3,224,823 | 12/1965 | Schulze | 312/114 |

FOREIGN PATENTS OR APPLICATIONS

| | | | |
|---|---|---|---|
| 1,435,106 | 3/1966 | France | 211/90 |

*Primary Examiner*—Kenneth Downey
*Attorney, Agent, or Firm*—McGarry & Waters

[57] ABSTRACT

A display case for bakery goods and the like wherein a cabinet having opposite sidewalls and a front glass wall mounts a plurality of shelves. A pair of elongated support brackets are demountably suspended at the sidewalls of the cabinet and contain vertically spaced support beams thereon. Crossbars are demountably supported by the bracket support means and wire racks are removably clipped to the crossbars. One or more of the crossbars at the front of the cabinet adjacent the glass wall houses a fluorescent fixture and a fluorescent lamp which are concealed from view from the front of the cabinet but which are exposed for illumination of the shelf therebeneath.

9 Claims, 6 Drawing Figures

DISPLAY CASE

BACKGROUND OF THE INVENTION

1. Field of the Invention

This invention relates to display cases for bakery goods and the like. In one of its aspects, the invention relates to a display case wherein interior shelves and supporting structures therefore are demountably mounted so that the shelves and supporting structures can be quickly and easily removed for fast yet effective cleaning of the entire bakery case.

2. State of the Prior Art

Bakery cases and other types of food display cases must be kept free from dirt, mold, bacteria and the like. Frequently, complete cleaning of such cases is required. Cleaning around permanent shelves is tedious and time consuming. More importantly, it is difficult to completely clean the shelves at the juncture of the shelves and the sidewalls. Bacteria and dirt may lodge at such junctures and contaminate food which is placed for display in the cases. To do a thorough job, all shelves and shelf supports must be completely removed from the case for cleaning purposes.

Heretofore, display cases have been made with pilasters or slotted brackets secured to the sidewalls of the case. Shelf brackets with hooks extended into the slots of the pilasters and supported the shelves. Lights were fixed on the front shelf brackets and were connected through metal conduit to a connector box. Thus, the pilasters and the front shelf brackets were essentially fixed within the case and could not as a practical matter be removed for cleaning of the case. The pilasters or slotted brackets cannot easily be cleaned and provide an obstruction for removing the shelves from the case. Dirt thus could accumulate within the slotted hollow brackets.

SUMMARY OF THE INVENTION

According to the invention, a display case having sidewalls, a top wall, bottom wall and a front glass wall, has elongated support brackets with a plurality of vertically spaced supporting means thereon and means for removably mounting the support brackets on the cabinet walls wihout tools. Crossbars extend between the support brackets on opposite sidewalls and have means for removably engaging the support means so that the crossbars are supported by the elongated support brackets. Shelves are supported by the crossbars and means releasably clip the shelves to the crossbars.

The elongated brackets comprise two vertical wire members having at least two wire lateral members joined thereto. Thus, the elongated brackets fit closely adjacent to the sidewalls and provide virtually no obstruction for removing the shelves from the case. Wire cross members extend across the vertical wire members and are bent at the ends to form hooks to provide the support means for the crossbars. Desirably, the upper ends of the vertical wire for members of the support brackets are bent outwardly at the top portion thereof and extend into holes at the top of the cabinet to suspend the support brackets above the bottom wall of the cabinet.

The crossbars are generally rectangular in cross-sections and have openings to receive the bent ends of the lateral braces. Desirably, the crossbar is of a length to press the support brackets against the sidewalls so that the brackets frictionally engage the bracket sidewalls.

At least one of the crossbars at the front of the cabinet has a fluorescent light fixture and a fluorescent lamp mounted therein. The fluorescent light fixture is connected to the ballasts and power supply through a wire with removable plugs so that the crossbar having the fluorescent lamp is easily removed from the case for cleaning purposes.

The shelves are formed from wire racks and are clipped through a spring clip to the crossbars. The spring clip is wrapped around one of the wires on the shelves and th supporting crossbar.

The display case, according to the invention, has demountable shelves and supports so that the interior of the case can be quickly and easily cleaned without obstruction. Further, the novel support brackets mount the shelves in an easily demountable manner without obstructing the removal and placement of the shleves within the casing.

BRIEF DESCRIPTION OF THE DRAWINGS

The invention will now be described with reference to accompanying drawings in which.

Figure 1:
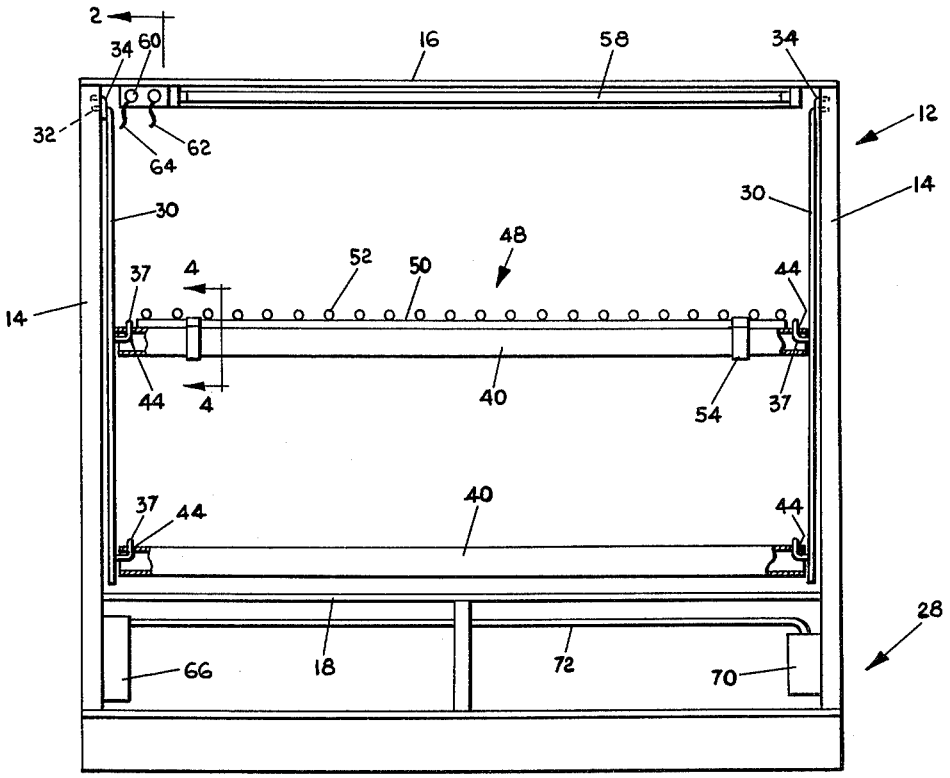
FIG. 1 is a rear elevational view, partly in section, of a display case according to the invention.

A pair of side support brackets 30 of wire are hung on the inside of each of the walls 14. To this end, the tops of the brackets 30 are bent outwardly to form hooks 34 which extend through holes in reinforcing plates 34 at the upper portions of the sidewalls 14.

Figure 3:
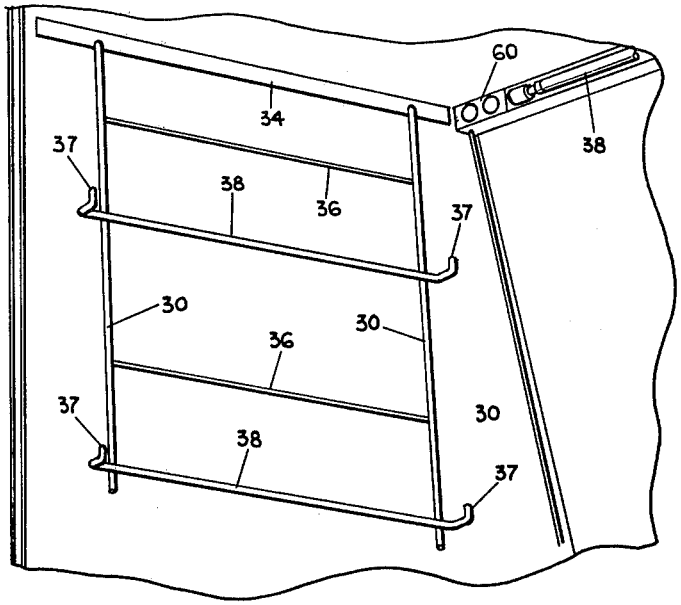
FIG. 3 is a perspective view of the interior portion of the display case with the rack and support bars removed.

As illustrated more clearly in FIG. 3, each of the side support brakcets 30 comprises two upright wires 35 joined by two coplanar lateral wire braces 36. The wires 35 and 37 form a rigid support structure. Lateral bars 38 extend across the inner edge of the upright wires 35 and are secured thereto by welding or other suitable fastening techniques. The ends of the lateral bars 38 are bent inwardly and then upwardly to form hooks 37.

Rear transverse support bars 40 and front transverse support bars 42 are suspended on the hooks 37 of the side support brackets 30. To this end, the ends of the support bars are open and openings 44 are provided near the ends of the support bars 40 and 42 for engaging the hooks 37. The support bars are sized to force the support brackets 30 against the sidewall 14 to provide a wedging action which assists in supporting the bakery racks from the support brackets 30.

Figure 4:
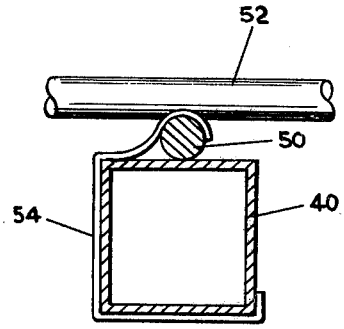
FIG. 4 is an enlarged partial section view along sides 4—4 of FIG. 1.

Wire racks 48 are in turn supported by the support bars 40 and 42. The racks consist of a plurality of parallel support wires 52 joined together by cross wires 50. A spring clip 54 (FIG. 4) wraps around the support bars 40 and around the cross wire 54 of each rack to secure the racks 48 in their respective positions on the cross bars.

Figure 2:
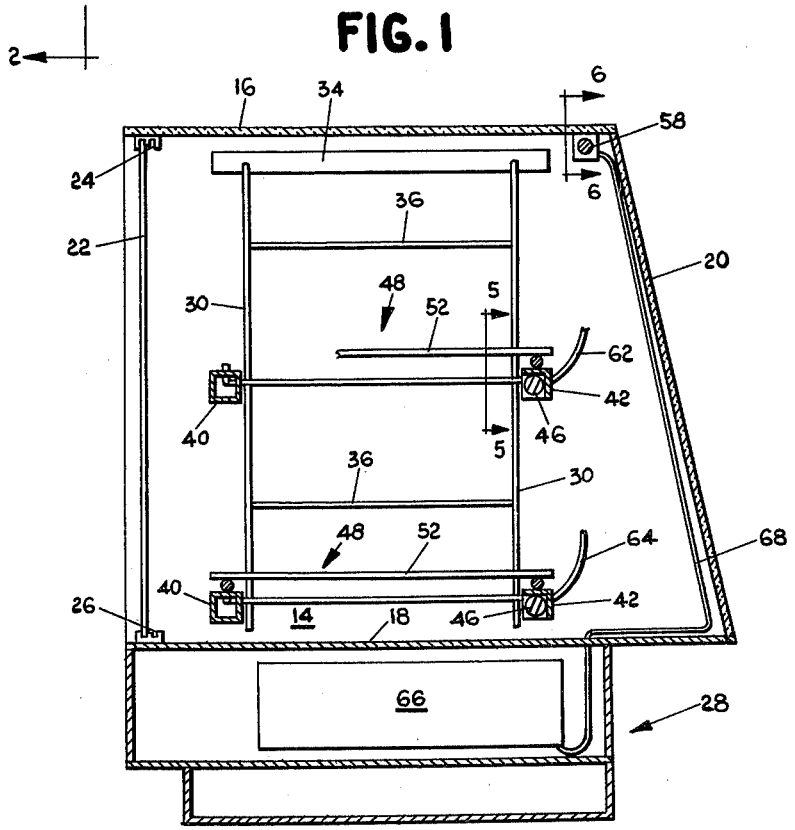
FIG. 2 is a side view in section seen along lines 2—2 of FIG. 2.
Figure 5:
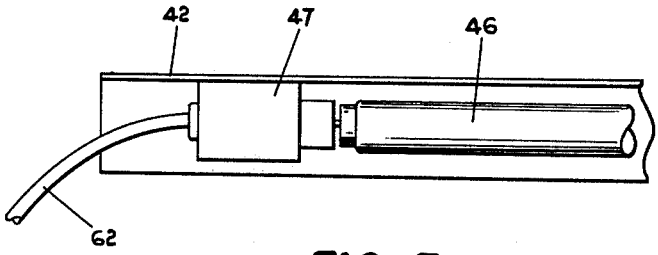
FIG. 5 is a partial sectional view seen along lines 5—5 of FIG. 2.
Figure 6:
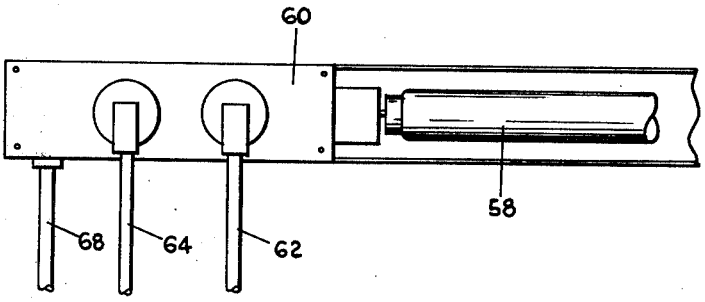
FIG. 6 is a partial sectional view along lines 6—6 of FIG. 2. DESCRIPTION OF THE PREFERRED EMBODIMENT Referring now to the drawings, there is shown a display case 12 formed of sidewalls 14, a top glass wall 16, a bottom wall, a front glass panel 20 and rear sliding doors 22. Channels 24 and 26 are provided at the upper and bottom portion of the cabinet for the sliding doors 22. A false bottom 28 is provided beneath the bottom wall 18. The side walls 14 and bottom wall 18 can be made of any suitable structural material such as wood, metal or glass. The top wall 16 likewise can be made of glass, plastic, metal or wood.

As seen in FIGS. 2 and 5, the support bars 42 are open at the back and bottom sides and contain a fluorescent light 46 and fixture 47 for illuminating goods on the bottom racks and on the bottom wall of the case. Wires 62 and 64 extend from the flourescent fixtures 47 along one side of the sidewalls and plug into a receptacle 60 at the top of the cabinet. Plugs are provided at the other end of wires 62 and 64 to plug into a receptacle in the fixtures 47 for ease of removing the support bars 42 from the display case.

A strip fluorescent fixture 58 is also provided at the top front of the cabinet to illuminate goods on the uppermost bakery rack 48.

Ballasts for all of the fluorescent lighting are provided in housing 66. Wires in a conduit 68 connect the ballasts in housing 66 with the various fluorescent fixtures through the receptacle 60. A power supply 70 is also provided in the false bottom 28 of the case and is connected to the ballasts through wire 72.

The bakery case of the invention provide a system whereby the racks and supports can be quickly and easily placed in and removed from the bakery case. In other words, the entire contents of the bakery case can be removed, including the side supports so that the walls can be easily and thoroughly washed down. Reassembly of the rack takes place by first placing the side support brackets on the sidewalls, positioning the transverse support bars 40 and 42 on the hooks 36 of brackets 30 and placing the wire rack 48 in place on the transverse support bars. The clips 54 are then placed around the support bars 40 to secure the wire rack 48 in place.

The invention thus provides a bakery case or other type of display case wherein the interior shelves and the supporting structure therefore are completely and easily removable for cleaning the interior of the case as well as the shelves and supports. The shelves and supporting structure are removable without tools and very quickly. After the shelves and supporting structure are removed, no obstruction or hard-to-clean areas are left. Further, lighting is provided within the cabinet and the lighting is also removable for the quick cleaning. The brackets at the sides of the cabinet provide virtually no obstruction for removing the shelves from the case or replacing the shelves within the case. The wire support brackets are very narrow so that internal obstructions are minimized. The suspension of the racks from the top of the cabinet avoids placement of holes at lower portions of the cabinet where dirt is more likely to accumulate. Further, the suspension of the support racks above the bottom wall of the case eliminates all obstructions from the bottom wall of the case so that the bottom wall can be wiped clean and free of crumbs on a daily or more frequent basis without removal of the racks and supporting structures.

Reasonable variation and modification are possible within the scope of the foregoing disclosure and drawings without departing from the spirit of the invention which is defined in the accompaying claims.

The embodiments of the invention in which an exclusive property or privilege is claimed are defined as follows:

1. A display case for display of bakery goods and the like, said display case comprising:

a cabinet having sidewalls, a top wall, a bottom wall and a front glass wall;

thin elongated support brackets having a plurality of vertically spaced support means thereon;

means removably mounting said support brackets on the sidewalls and spaced above the bottom wall so that the brackets can be quickly and easily removed without the use of tools, said mounting means consisting of receiving means at an upper portion of the sidewalls and means at an upper portion of the support brackets for slidably engaging the receiving means;

at least two crossbars extending between the support brackets on opposite sidewalls, the crossbars having means for removably engaging the support means so that the crossbars are supported by the elongated support brackets and the crossbars further including means for pressing the support brackets against the sidewalls so that the brackets are at least partially held by frictional contact with the sidewalls;

shelves supported by the crossbars; and means releasably fastening the shelves to the crossbars;

whereby the shelves of the display case can be quickly and easily removed and replaced for complete cleaning of the case interior.

2. A display case according to claim 1 wherein said thin elongated brackets comprise at least two vertical wire members having at least two wire lateral braces joined thereto.

3. A display case according to claim 2 wherein said receiving means comprise at least two holes in each sidewall of the cabinet at an upper portion thereof, and the slidable engaging means comprise at least two lateral projecting hooks on the support bracket, which hooks fit into the holes to provide the sole support for the supporting brackets.

4. A display case according to claim 3 wherein the vertical wire members extend to a point above the bottom wall of the case.

5. A display case according to claim 2 wherein the supporting means are formed by wires bent inwardly from the two vertical wire members.

6. A display case according to claim 5 wherein the crossbars have openings to receive the inwardly bent wires.

7. A display case according to claim 6 wherein at least one of the crossbars at the front of the display case has a fluorescent light fixture and a fluorescent lamp mounted therein, said one crossbar having open bottom and rear portions such that light from the fluorescent lamp illuminates goods on the shelf therebeneath, yet the lamp and fixture are substantially shielded from view through the front glass wall; a ballast mounted within the case and an electrical connector including a removable plug connecting the fluorescent light fixture to the ballast.

8. A display case according to claim 7 wherein the shelves are formed from a wire rack and the releasable fastening means for the wire racks comprise a spring clip which is wrapped around a wire on the wire rack shelf and around a supporting crossbar.

9. A display case according to claim 1 wherein at least one of the crossbars at a front portion of the display case has a fluorescent light fixture and a fluorescent lamp mounted therein, the one crossbar having open bottom and rear portions such that the light from the fluorescent lamp illuminates goods on the shelf beneath the one crossbar, yet the lamp and fixture are substantially shielded from view through the front glass wall; a ballast mounted within the display case; and means, including a plug for connecting the fluorescent light fixture to the ballast so that light fixture can be quickly and easily removed from the bakery case.

* * * * *